US008317953B2

(12) United States Patent
Sawka et al.

(10) Patent No.: US 8,317,953 B2
(45) Date of Patent: Nov. 27, 2012

(54) FAMILY OF METASTABLE INTERMOLECULAR COMPOSITES UTILIZING ENERGETIC LIQUID OXIDIZERS WITH NANOPARTICLE FUELS IN SOL-GEL POLYMER NETWORK

(75) Inventors: Wayne N. Sawka, Reno, NV (US); Charles E. Grix, Carmichael, CA (US)

(73) Assignee: Digital Solid State Propulsion, LLC, Reno, NV (US)

( * ) Notice: Subject to any disclaimer, the term of this patent is extended or adjusted under 35 U.S.C. 154(b) by 335 days.

(21) Appl. No.: 12/467,209

(22) Filed: May 15, 2009

(65) Prior Publication Data

US 2011/0030859 A1 Feb. 10, 2011

Related U.S. Application Data

(60) Provisional application No. 61/053,916, filed on May 16, 2008.

(51) Int. Cl.

| | |
|---|---|
| ***C06B 45/00*** | (2006.01) |
| ***C06B 31/00*** | (2006.01) |
| ***C06B 31/28*** | (2006.01) |
| ***D03D 23/00*** | (2006.01) |
| ***D03D 43/00*** | (2006.01) |

(52) U.S. Cl. ..... 149/109.6; 149/2; 149/45; 149/46

(58) Field of Classification Search ..... 149/109.6, 149/2, 45, 46

See application file for complete search history.

(56) References Cited

U.S. PATENT DOCUMENTS

| | | | | |
|---|---|---|---|---|
| 5,734,124 | A * | 3/1998 | Bruenner et al. | 149/36 |
| 6,910,420 | B1 * | 6/2005 | Thompson et al. | 102/202.5 |
| 2006/0053970 | A1 | 3/2006 | Dreizin | |
| 2007/0095445 | A1 | 5/2007 | Gangopadhyay | |
| 2007/0113939 | A1 * | 5/2007 | Chan et al. | 149/19.3 |
| 2008/0134924 | A1 | 6/2008 | Sawka | |

* cited by examiner

*Primary Examiner* — James McDonough

(74) *Attorney, Agent, or Firm* — Temmerman Law Office; Mathew J. Temmerman

(57) ABSTRACT

A new process for forming MICs as well as three exemplary categories of MIC formulations is disclosed. MICs disclosed herein include a first exemplary category for which combustion can be initiated and sustained by either a heat (flame) source or electrical power, a second exemplary category of formulations that can be ignited and that sustain combustion at low pressures only with electrical power and a third exemplary category of formulations that can be ignited and extinguished at low pressures only with electrical power. The new process of MIC formulation provides energetic liquid oxidizers in place of traditional solvents, thus eliminating the need for solvent extraction. The energetic liquid oxidizer serves as a medium in which to suspend and grow the 3D nanostructure formed by the cross linked polymer (PVA). As a consequence, the 3D nanostructure entraps the liquid oxidizer, preventing it from evaporating and thereby eliminating the need for solvent extraction, preserves the 3D nanostructure shape. Further, the liquid oxidizer matrix produces provides a mechanism through which ignition and combustion may be controlled. The material combustion rate may be adjusted/throttled through adjustments in the amount electrical power supply and may even be extinguished by complete removal of the electrical power supply. Repeated on/off ignition/extinguishment is possible through repeated application and removal of electrical current.

13 Claims, 5 Drawing Sheets

Combustion Gas Composition, in mmoles/g

| Gas species | BKMNO4 | ALKMNO4 | HPB,Z | HPPA | HPP |
|---|---|---|---|---|---|
| Acids | 0 | 0 | 4.031551 | 0.405186 | 0.1296 |
| CO | 0 | 0 | 20.86766 | 6.393841 | 0 |
| CO2 | 0 | 0 | 0 | 1.839546 | 6.3474 |
| H2 | 0 | 0 | 1.621384 | 0.810373 | 0.001 |
| H20 | 0 | 0 | 0 | 7.188801 | 23.6656 |
| Metal Ox | 17.85 | 11.78 | 20.86766 | 15.34846 | 0.0328 |
| N2 | 1.23 | 1.28 | 7.616125 | 8.229336 | 9.5943 |
| O2 | 0 | | 0 | 0 | 0.3878 |
| *Metal | 3.48 | 5.4 | 2.013393 | 0 | 0 |

FAMILY OF METASTABLE INTERMOLECULAR COMPOSITES UTILIZING ENERGETIC LIQUID OXIDIZERS WITH NANOPARTICLE FUELS IN SOL-GEL POLYMER NETWORK

RELATED APPLICATIONS

This application claims priority from U.S. provisional patent application Ser. No. 61/053,916, filed May 16, 2008, entitled "Family of Metastable Intermolecular Composites Utilizing Energetic Liquid Oxidizers with NanoParticle Fuels In Gel-Sol Polymer Network", which is hereby incorporated by reference herein in its entirety as if set out in full.

This application is further related to previously filed U.S. patent application Ser. No. 10/136,786, filed Apr. 24, 2003, entitled "Electrically Controlled Propellant Composition and Method", and to previously filed U.S. patent application Ser. No. 11/787,001, filed Apr. 13, 2007, entitled "High Performance Electrically Controlled Solution Solid Propellant", all of which are incorporated by reference herein in their entirety.

Further, this application is related to three U.S. provisional patent applications filed on May 16, 2008, entitled "Family of Modifiable High Performance Electrically Ignitable Solid Propellants" (Ser. No. 61/053,900), "Electrode Ignition and Control of Electrically Ignitable Materials" (Ser. No. 61/053,971), and "Physical Destruction of Electrical Device and Method for Triggering Same" (Ser. No. 61/053,956), all of which are hereby incorporated by reference herein in their entirety as if set out in full. This application is further related to one U.S. patent applications and two PCT applications filed on an even date herewith: "Family of Modifiable High Performance Electrically Controlled Propellants and Explosives" filed as a PCT application, "Electrode Ignition and Control of Electrically Ignitable Materials" filed as a PCT Application, and "Physical Destruction of Electrical Device and Methods for Triggering Same" filed as a U.S. Application.

SECRECY ORDER

The present application incorporates by reference U.S. patent application Ser. Nos. 11/305,742 and 10/136,786, which were previously under a secrecy order per 37 CFR 5.2.

STATEMENT REGARDING FEDERALLY SPONSORED RESEARCH OR DEVELOPMENT

Portions of the invention described herein were made in part with Government support under a Small Business Innovative Research Contract ("Miniaturized Safe-Fuel Electrically Controlled Divert & Attitude Control System," Contract No. N65538-07-M-0119 subcontract number A630-1341 under primary contract N00014-08-C-0109 to DE Technologies Inc, King of Prussia, Pa.) awarded by the United States Navy and a subcontract under the Office of Naval Research, DE Technologies Inc. ("Tactical Urban Strike Weapon: Safe Fire-From-Enclosure the Marine Alternative to Double-base Propellants," subcontract number #A630-1341). The government may have certain rights in the inventions disclosed herein.

BACKGROUND

1. Field of the Invention

The present invention relates to a new family of metastable intermolecular composites ("MICs"), and particularly to a family of metastable intermolecular composites utilizing energetic liquid oxidizers with nanoparticle fuels in a sol-gel polymer network.

2. Description of the Related Art

Metastable intermolecular composite (also called nanothermites or super-thermites) materials are a subclass of thermite materials in the nanometer length scale range. They are a pyrotechnic composition typically comprising an oxidizer and a reducing agent that undergoes an exothermic reaction when heated to a critical temperature. MICs are distinguished from conventional thermites in that the oxidizer and reducing agent, normally iron oxide and aluminum, are not a fine powder, but rather nanoparticles. As the mass transport mechanisms that slow down the burning rates of traditional thermites are not so important on the nano-scale, the reactions become kinetically controlled and much faster. Although they may be easily stimulated to become unstable, MICs exist in a state of pseudo-equilibrium that has a free energy higher than that of the true equilibrium state. Because of these and other advantages, MICs are offer improved performance over other energetic materials in areas such as sensitivity, stability, energy release and mechanical properties, and are becoming useful in applications in propellants, explosives, and pyrotechnics.

Conventional MIC formulations use solid oxidizer components being either metal oxides such as $Fe_2O_3$ CuO, MoO or $KmnO_4$ with nano-sized fuel particles generally comprising one of or a mixture of aluminum, boron, beryllium, hafnium, lanthanum, lithium, magnesium, neodymium, tantalum, thorium, titanium, yttrium, zirconium, or other metals. Current MIC compositions employing metal oxidizers and metal fuels generate large amounts of heat, making them useful for applications for cutting metal and for the discharge of their main combustion product, hot metal fragments. However, traditionally MIC compositions have been relatively poor gas generators, making them a suboptimal candidate for propellant systems or gas generating control systems.

The rate of energy release in a MIC reaction is inversely proportional to the size of the MIC components. MICs comprising components on a nano-scale tend to be easier to ignite than traditional thermites, and indeed produce an explosion type reaction due to the large surface area and high amounts of heat generated by the reaction therein.

As a means for forming MICs, it is well recognized that the sol-gel process is an inexpensive, simple and efficient mechanism. The sol-gel process as it pertains to MIC formation involves reacting chemicals in a solvent to produce primary nanoparticles that are linked in a 3D solid network, the gaps in the 3D network filled in by the remaining solution. To isolate the MICs produced, the remaining solvent must be removed. The solvent may be removed through controlled evaporation or supercritical extraction, forming Xerogels in the former process and Aerogels in the latter. Regardless of the means of solvent removal, the finalized MIC product is left behind.

A first drawback to the formation of conventional MICs in this manner is with regard to the process of separating the solvent from the nanostructure. Unfortunately, this process has traditionally been detrimental to the preservation of the shape of the nanostructure framework. Indeed, either the conventional supercritical solvent extraction or the solvent extraction/evaporation steps result in a product that has either undergone complete 3D nanostructure collapse (in the case of Xerogels) or at the very least minor 3D nanostructure shrinkage (in the case of Aerogels). This damage to the 3D nanostructure eliminates the possibility of creating complex molded shapes due to the nanostructure pulling away from (or collapsing entirely within) any mold in which it was designed to fit. There is thus a need for creating a MIC with that does not undergo 3D collapse or shrinkage during preparation.

A second drawback to conventional MICs that utilize metal powders is that once initiated, their combustion may not be electrically controlled. Thus, in conventional MICs, burn rate and reactive power must be controlled indirectly through the control of particle size. Complete extinguishment is not possible. Rather, after initiation the conventional MIC reaction generates its own heat absent of any pressure effects, even if pressure drops to zero. Thus, in applications where conventional MICs may be used for igniters for ignition of solid propellants, they are limited to a one-time use. There is thus a need for an electrically controlled MIC to allow for multiple start-stop ignitions of solid, liquid, or hybrid propellant systems.

A third drawback to conventional MICs employing nano-sized metal is the high chance for accidental ignition by electrostatic discharge. That is, conventional MICs are spark sensitive. Currently, major considerations for successful weaponization of energetic materials include energy release rate, long-term storage stability, and sensitivity to unwanted initiation. Currently, conventional MICs are thus combined with carbon to reduce the chance of accidental electrostatic discharge. There is thus a need for a MIC that is not ignitable by accidental electrostatic discharge and that can eliminate the common step of combination with carbon.

A fourth drawback to conventional MICs involves their use in certain military, space and commercial applications wherein it is desirable that a propellant combust without a visible exhaust plume, such as for stealth purposes or because the exhaust particulates and smoke interfere with guidance control. Referred to as "smokeless" formulations, such formulations typically comprise no metal fuels or chlorine based oxidizers such as ammonium perchlorate. Conventional formulations utilize oxidizers referred to as nitramines and consist of 1,3,5-trinitro-1,3,5-triazacyclohexane (RDX) or 1,3,5,7-tetranitro-1,3,5,7 tetraazacyclooctane (HMX). More recently, newer higher nitrogen compounds Bis(aminotetrazolyl)tetrazine (BTATZ), dihydrazino-tetrazine (DHT) and Guanidinium azo tetrazolate (GUAZT) have been developed and proposed as additives that could be used with 5-amino tetrazole and potassium nitrate ($KNO_3$) or potassium perchlorate ($KClO_4$) to produce a reduced or smokeless MIC. To date, the cost of producing these materials is expensive and they have been found to be spark sensitive. There is thus a need for a MIC propellant combustible without a visible exhaust plume and that is both inexpensive to prepare and spark insensitive once prepared.

U.S. Pat. No. 5,734,124 to Bruenner, et al., entitled "Liquid Nitrate Oxidizer Compositions", describes the formation of liquid nitrate eutectic compositions for solid solution or emulsion propellants wherein inorganic nitrate oxidizers are combined in eutectic compositions that place the oxidizers in liquid form at ambient temperatures, but that could used in the preparation of a wide variety of energetic formulations, notably solution and emulsion propellants made of ammonium nitrate, hydrazinium nitrate, hydroxylammonium nitrate and/or lithium nitrate, including eutectics. These propellants, which contain a metal fuel, a hydrocarbon polymer and the liquid oxidizer, form a gel structure that supports the metal fuel and may be used. No suggestion for an application to MICs is disclosed.

U.S. Patent Publication 2006/0053970 A1 to Dreizin and Schoenitz, entitled "Nano-composite energetic powders prepared by arrested reactive milling", describes a method for producing an energetic metastable nano-composite material by arresting the milling process at a known duration before a spontaneous reaction is known to occur. The milled powder is recovered as a highly reactive nanostructured composite for subsequent use by controllably initiating destabilization thereof.

U.S. Patent Publication 2007/0095445 A1 to Gangopadhyay et al., entitled "Ordered nanoenergetic composites and synthesis method", describes one such means for achieving the dispersion effect using a solvent and sonic waves (sonification). Here, the nano-sized fuel particles such as aluminum nanoparticles are placed in an alcohol solvent such as 2-propanol and are sonicated for a time sufficient to achieve homogenous dispersion and the removal of all of the molecular linker except the layer that is bound to the fuel or the oxidizer. A very high fuel surface area results, thereby increasing the explosive characteristics of the formulation. While this method has its advantages, it still relies on a solvent that must be extracted before the process is complete.

SUMMARY OF THE INVENTION

A new process for forming MICs as well as three exemplary categories of MIC formulations is disclosed herein. The new process provides for the formulation of MICs with energetic liquid oxidizers in place of traditional solvents, thus eliminating the need for solvent extraction. The energetic liquid oxidizer serves as a medium in which to suspend and grow the 3D nanostructure formed by the cross linked polymer (PVA). As a consequence, the 3D nanostructure entraps the liquid oxidizer, preventing it from evaporating, and preserving the stable shape. The metal nano-particles then self-assemble within the 3d nanostructure to form a homogenous phase. The self-assembly method as depicted in FIG. 1 shows that the liquid oxidizer as the solvent swells and dissolves a polymer forming a colloid solution of the metal particles. During the gel-sol and crosslinking phase the 3-D structural network forms dispersing and encapsulating the metal particles forming a uniform single phase of metal/fuel and oxidizer. Because the liquid oxidizer serves as a non-volatile solvent of the composite, the formation of sol-gel composites through the method disclosed herein does not require the conventional step of removing solvent. Thus the ability to cast and cure to create a 3D gel network in which there is intimate contact between the oxidizer and the fuels is provided.

The new categories of MICs include a first exemplary category for which combustion can be initiated and sustained by either a heat (flame) source or electrical power, a second exemplary category of flame insensitive formulations that can be ignited with only electrical power and can sustain combustion at low pressures even after power is removed, and a third exemplary category of formulations that can be ignited and extinguished at low pressures with electrical power.

The liquid oxidizer matrix is present in all three formulations, and provides a means for delivery of electrical power to initiate and control combustion. The combustion rate may be increased/throttled through increased electrical power supply, reduced through the reduction of electrical power supply and extinguished by removal the electrical power supply. Multiple pulses of on/off combustion are provided.

BRIEF DESCRIPTION OF THE FIGURES

The foregoing aspects and many of the advantages of the invention will become more readily appreciated as the same becomes better understood by reference to the following detailed description, when taken in conjunction with the accompanying drawings, wherein.

DETAILED DESCRIPTION OF THE INVENTION

Figure 1:
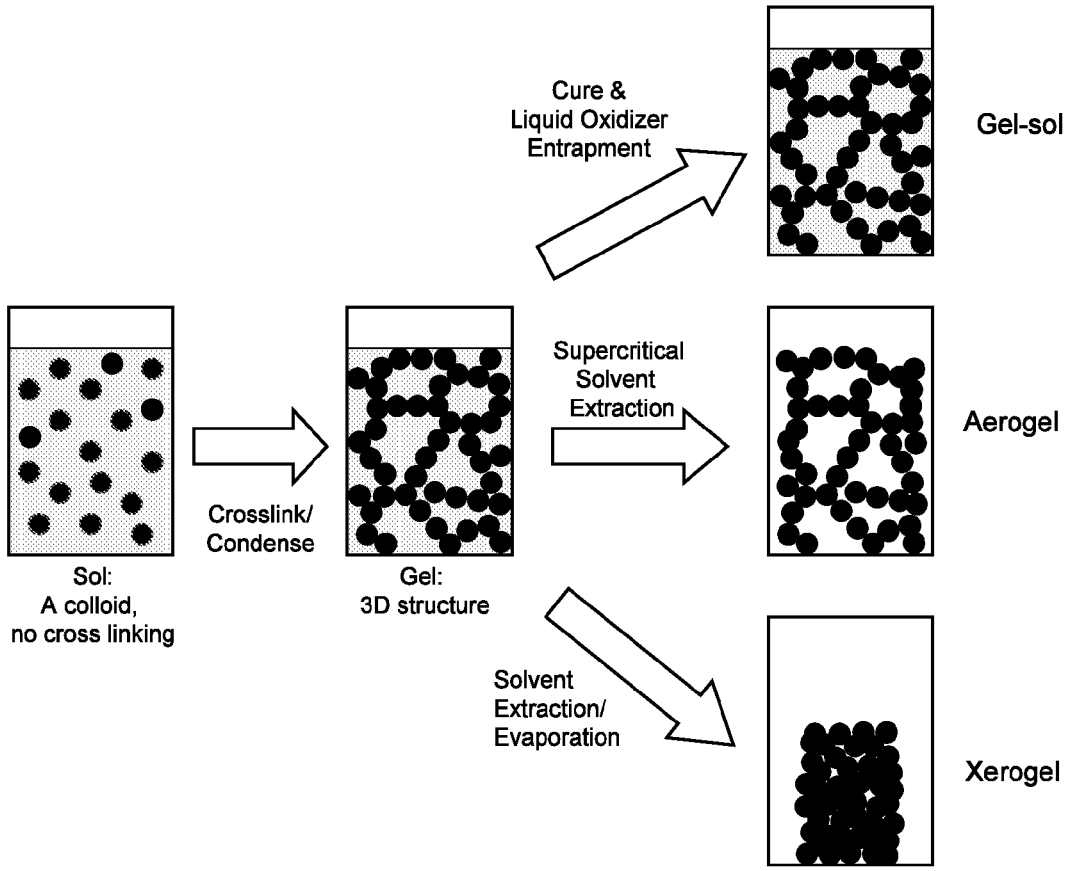
FIG. 1 illustrates an overview of the process described herein, as well as drawbacks to the conventional methods of MIC formation.

FIG. 1 illustrates an overview of the MIC formation process described herein, as well as drawbacks to the conventional methods of MIC formation. It should be noted here that although the International Union of Pure and Applied Chemistry recommends referring to MICs as transient chemical species, for purposes of this application the term metastable intermolecular composites, or ("MICs"), is used. Returning to FIG. 1, MIC formation traditionally involves growing a 3D nanostructure in a colloid through cross-linking. As discussed above, the use of either conventional process of supercritical solvent extraction or solvent extraction/evaporation results in a product that has either collapsed entirely or at a minimum shrunk to a small degree. However, following the process disclosed herein, the step of solvent removal is eliminated because the solvent used, namely liquid oxidizer, is and remains an energetic component of the composite. The use of the energetic liquid oxidizer eliminates the conventional step of solvent removal, and consequently the nanostructure collapse associated therewith. The energetic liquid oxidizer serves as a medium in which to suspend and grow the 3D nanostructure formed by the cross-linked polymer). Examples of applicable polymers include alkyl polymers, alkyl nitrates polymers and the like. Specific examples include but are not limited to polyvinyl alcohol and polyvinylamine nitrate and the co-polymers thereof.

Figure 2:
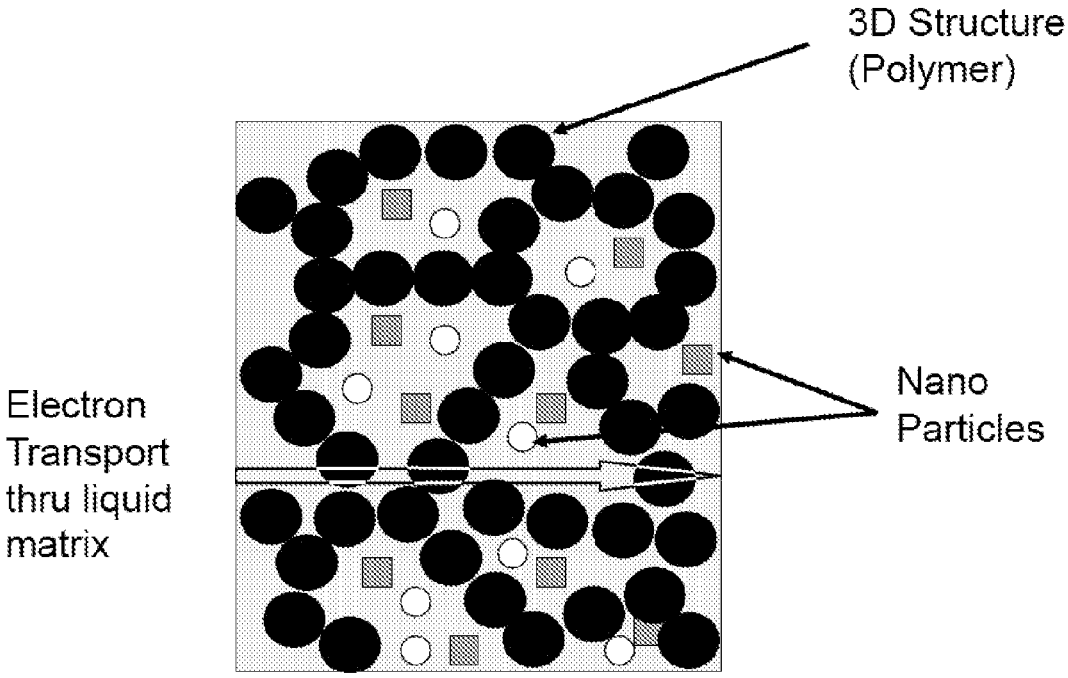
FIG. 2 illustrates the 3D matrix formed by the liquid oxidizer allowing electron transport through and deliver to ignition sites governed by external electrode polarity, geometry and electrical power supplied. This 3D matrix is also the mechanism by which nanoparticles are more uniformly dispersed within the gel sol, inhibiting location agglomerations that would cause location non-stoichiometry.

As a consequence, the 3D nanostructure entraps the liquid oxidizer and duel particles, as shown during the "Cure & Liquid Oxidizer Entrapment" step in FIG. 1. The nano-particles within the forming 3D nanostructure self-assemble within the 3D nanostructure to form a homogenous phase. The self-assembly method as depicted in FIGS. 1 and 2 shows that the liquid oxidizer as the solvent swells and dissolves a polymer forming a colloid solution of the metal particles. Because the liquid oxidizer does not evaporate, the shape formed is stable.

A continuous 3D matrix is formed by the liquid oxidizer allowing electron transport through and deliver to ignition sites governed by external electrode polarity, geometry and electrical power supplied (AC or DC) entitled, "Electrode Ignition and Control of Electrically Ignitable Materials," and previously incorporated herein by reference. Essentially, the electrically ignitable propellant is initiated and controlled through the application of electric current. In a preferred embodiment, the apparatus may include a power supply and controller in electrical communication with electrodes for supplying a potential across the electrodes to initiate combustion of and control the combustion rate of the MIC. The material combustion rate may be increased/throttled through increased electrical power supply and even extinguished by removing the electrical power supply. The cross-linking network aids in the uniform dispersion of nonmetals, glass fuels and burn rate enhancers.

The invention is further illustrated in the following examples, which are to be considered as exemplary and not definitive of the invention. In summary, three exemplary categories of formulations are disclosed: A first exemplary category for which combustion can be initiated and sustained by either a heat (flame) source or electrical power, a second exemplary category of formulations that can be ignited and that sustain combustion at low pressures with only electrical power and a third exemplary category of formulations that can be ignited and extinguished at low pressures with the application and removal of, respectively power.

The first exemplary embodiment of the invention describes those formulations that can be ignited and that sustain combustion at low to ambient pressures with either a flame or electrical power. The liquid oxidizer contains hydroxylamine nitrate (HAN) with co-oxidizers to form room temperature liquids. It may alternatively contain eutectic mixtures of ammonium nitrate (AN) with other organic nitrate salts such as guanidinium nitrate, ethanol amine nitrate to form low melting liquids and/or with energetic deep eutectic solvents consisting of an energetic oxidizer component with other salts found to depress the melting point of ammonium nitrate or other nitrate based oxidizers. Importantly, the formulation contains the metal boron, however, other metals such as aluminum, zirconium, tungsten, or titanium may be mixed with boron in the MIC formulation while still maintaining the described combustion properties.

Successful composite formulations have been prepared that utilize nano-sized boron metal fuel with HAN eutectic oxidizer in a sol-gel formed with polyvinyl alcohol. One exemplary MIC formulation is described in Table 1A, below, wherein S-HAN-5 may comprise other ingredients acting as stabilizers such as buffer, metal chelating agents, and radical scavengers.

TABLE 1A

A preferred MIC Formulation comprising Boron

| Material | Weight Percent |
|---|---|
| S-HAN-5 | 62.0 ± 3.0 |
| Polymer | 14.0 ± 2.0 |
| Boron (nano powder) | 20.0 ± 5.0 |
| Crosslinker | 2.0 ± 1.0 |
| Other Additives | 5.0 ± 3.0 |

A more general formula with broader ranges of constituents is described below in Table 1B.

TABLE 1B

A MIC Formulation comprising Boron

| Material | Weight Percent |
|---|---|
| S-HAN-5 | 66.0 ± 10.0 |
| Co-oxidizer | 10.0 ± 10.0 |

TABLE 1B-continued

| A MIC Formulation comprising Boron | |
|---|---|
| Material | Weight Percent |
| Polymer | 14.0 ± 2.0 |
| Boron (nano powder) | 12.0 ± 8.0 |
| Crosslinker | 1.0 ± 1.0 |
| Other Metals | 10.0 ± 5.0 |
| Other Additives | 5.0 ± 3.0 |

The above Boron metal-based MICS sustain combustion either by electrical power or a flame source at ambient pressures. In Table 1B, S-HAN is stabilized hydroxylamine nitrate that contains the pure material, buffering agents, metal chelating agents and other stabilizers. Co-oxidizers may include but are not limited to ammonium nitrate, ethylamine nitrate, ethanolamine nitrate, hydrazine nitrate, sodium nitrate, ethylamine nitrate, methyl nitrate and ethylene diamine dinitrate, and other additives may include metal chelates, burn rate modifiers such as metal salts and surfactants.

The second exemplary embodiment of the invention (see Tables 2A and 2B) describes those formulations that are resistant to ignition by flame but are ignitable by DC power greater than or equal to 100 watts and that sustain combustion at ambient temperature and pressure. Thus, the second exemplary embodiment adds an amount of safety over the Boron metal-based MIC described above. This embodiment discloses a MIC prepared using liquid oxidizer HAN, PVA polymer and aluminum powder, as described in the following two tables. Indeed, MICs formed according to Table 2 are sustainable at ambient pressure and temperature by input of electrical power and not by a flame source. Further, the aluminum based MICs produce a metal oxide combustion product ($Al_2O_3$) as a high performance (Isp) gaseous flow product, whereas Boron based MICs tend to burn at the surface and produce lower performance (Isp) liquid oxide products.

An exemplary MIC formulation prepared as described appears below in Table 2A.

TABLE 2A

| A preferred MIC Formulation Comprising Aluminum | |
|---|---|
| Material | Weight Percent |
| S-HAN-5* | 59.0 ± 3.0 |
| Polymer | 14.0 ± 2.0 |
| Aluminum powder | 20.0 ± 5.0 |
| Crosslinker | 2.0 ± 1.0 |
| Other Additives | 5.0 ± 3.0 |

A more general formula with broader ranges of constituents is described below in Table 2B. The more general aluminum-containing formula shown in Table 2B comprises the energetic polymer polyethanolaminobutyne nitrate (PEABN). These formulations may also utilize boron nano powders that have been coated with aluminum.

TABLE 2B

| Alternative MIC Formulation Comprising Aluminum and PEABN | |
|---|---|
| Material | Weight Percent |
| S-HAN-5 | 66.0 ± 10.0 |
| Co-oxidizer | 10.0 ± 10.0 |
| Polymer | 8.0 ± 8.0 |
| PEABN | 7.0 ± 7.0 |
| Aluminum powder | 20.0 ± 5.0 |

TABLE 2B-continued

| Alternative MIC Formulation Comprising Aluminum and PEABN | |
|---|---|
| Material | Weight Percent |
| Other Metals | 5.0 ± 5.0 |
| Other Additives | 10.0 ± 10.0 |

PEABN is a new polymer compound described as follows:

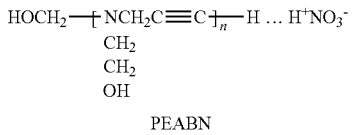

PEABN

Where n = 20-40

A third exemplary embodiment of the invention (see Tables 3A and 3B) contains low levels of a metal burn rate catalyst and PEABN. This exemplary formulation has demonstrated high insensitive munitions properties (flame and spark ignition insensitive) and extinguishment at low pressures when electrical power is removed. Further, repeated on/off pulsing and variable combustion properties dependent on the degree of enhancement by electrical power input is possible. Under high electric input, burn rates are higher than the conventional composite propellants prepared with nitramine oxidizers, the new high nitrogen based MICs (BTATZ, DHT, and GUAZT) and the metal-based MICs previously described. In addition, these formulations are "smokeless" in that there is no smoke or acid vapor cloud generated by the combustion products.

Figure 4:
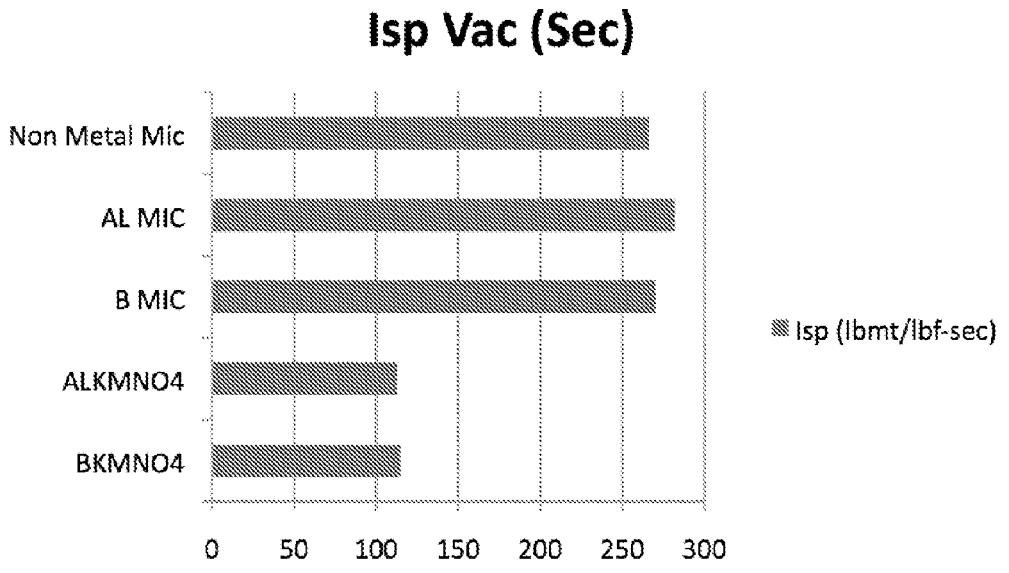
FIG. 4 shows a comparison of specific impulse of conventional MICs against that of the MICs disclosed herein.
Figure 7:
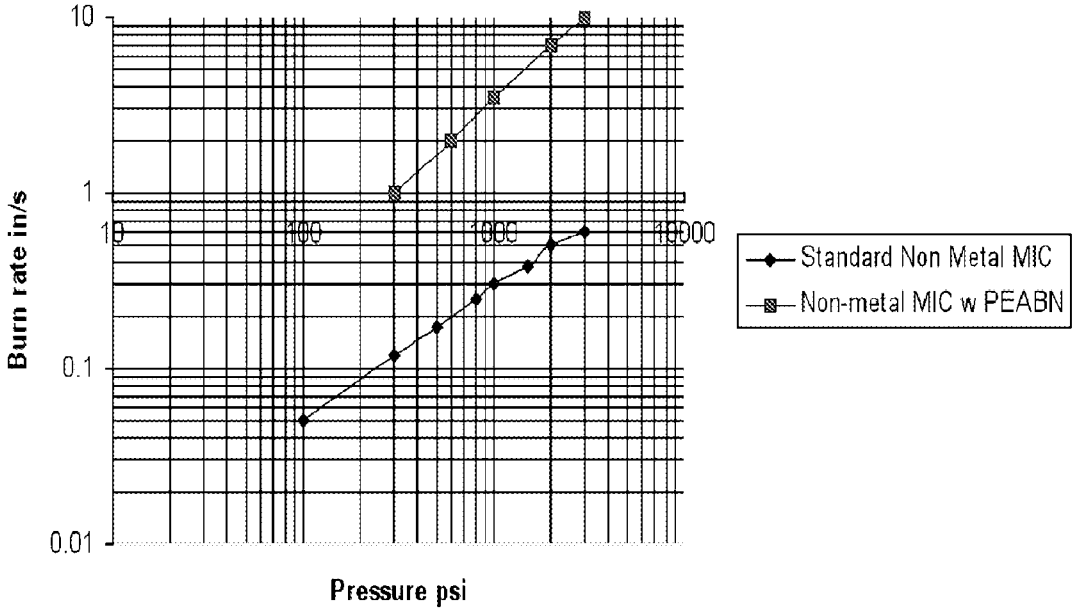
FIG. 7 shows a comparison of burn rates between a standard non-metal MIC and the applicant's non-metal MIC comprising polyethanolaminobutyne nitrate.

The combustion products for these formulations consist primarily of $CO_2$, $H_2O$, and $N_2$. The addition of the PEABN to these formulations has shown to have a pronounced effect on the burn rate of the baseline propellant as shown in FIG. 4. The effect may be attributable to the energy release of the acetylene carbon bonds and the high hydrogen content of the polymer as shown in FIG. 7.

An exemplary MIC formulation prepared as described appears below in Table 3.

TABLE 3A

| A preferred nonmetal MIC Formulation comprising PEABN | |
|---|---|
| Material | Weight Percent |
| S-HAN-5 | 82.15 ± 2.00 |
| PEABN | 2.75 ± 0.25 |
| PVA | 11.00 ± 0.25 |
| Crosslinker | 1.00 ± 1.00 |
| Other Additives | 1.10 ± 1.00 |

A more general formula with broader ranges of constituents is described below in Table 3B.

TABLE 3B

| A more general nonmetal MIC Formulation comprising PEABN | |
|---|---|
| Material | Weight Percent |
| S-HAN-5 | 80.0 ± 5.0 |
| Co-oxidizer | 10.0 ± 10.0 |
| Polymer | 8.0 ± 8.0 |
| PEABN | 7.0 ± 7.0 |

TABLE 3B-continued

| A more general nonmetal MIC Formulation comprising PEABN | |
|---|---|
| Material | Weight Percent |
| Burn Rate Catalysts | 5.0 ± 5.0 |
| Other Additives | 2.0 ± 2.0 |

While the above formulation utilizes both PVA and PEABN polymer. Since the effect demonstrated by the addition of PEABN at levels of 20-40% of the polymer composition was dramatic, it would be expected that a more energetic MIC material could be prepared by an improvement in the synthesis of PEABN to yield a higher molecular weight polymer. An exceptionally very fast burning rate propellant utilizing only the PEABN may be prepared for use as a flame insensitive alternative for primer cord initiators currently made with Pentaerythritol tetranitrate (PETN).

Figure 3:
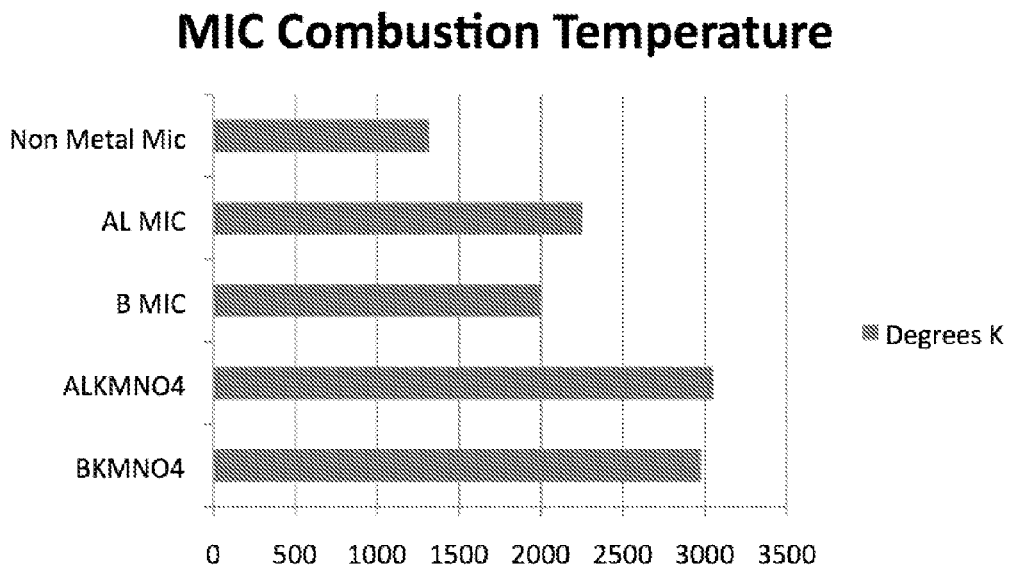
FIG. 3 shows a comparison of combustion temperatures of conventional MICs against those of the MICs disclosed herein.

The various thermo chemical properties and performance of this new family of MICs are illustrated in FIGS. 3-6. FIG. 3 compares the combustion temperature of the three MICs disclosed above as compared to conventional MIC preparations. The drawback of MICs formed utilizing micron-sized aluminum is that the combustion temperatures produced are lower than in nano-particle metal based MICs. A comparison of thermal-chemical properties and gas compositions of conventional metal-based MICs and the MICs disclosed herein is shown in FIGS. 3 and 4.

Figures 5, 6:
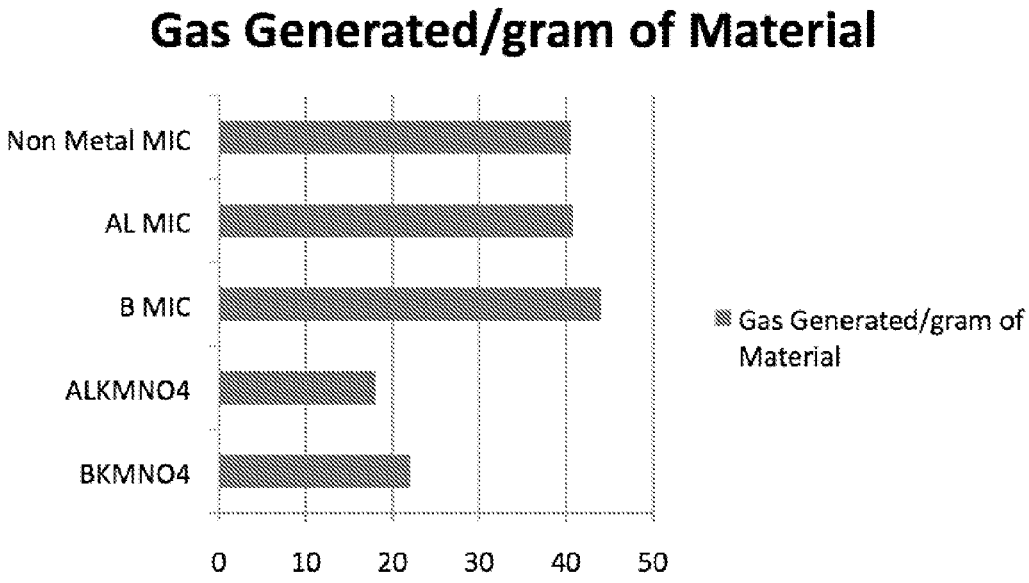
FIG. 5 shows the amount of gas generated (in mMoles) per gram of several of the MIC formulations disclosed herein.
FIG. 6 shows the amount of various gasses generated (in mMoles) per gram of several of the MIC formulations disclosed herein.

FIG. 4 illustrates the improvement of the specific impulse of the composition in a vacuum while FIGS. 5 and 6 illustrate improvement in the amount of gas generation. FIG. 5 details total gas generated while FIG. 6 breaks the gas data down into its constituent parts.

Because the present method utilizes ionic liquids that serve as both the oxidizer and solvent to form a plastisol gel with the polymer, these downsides to the conventionally requires step of solvent extraction are eliminated. Instead, the shape and dimensions of the cast geometry is maintained during the cure process in which the material transforms from a fluid castable liquid to a tough rubbery solid. Hence, procedures not possible using traditional sol-gel processes are now feasible. For instance, near net shape vacuum casting and near complete filling of open cell foam structures made of glass, metals such as aluminum, titanium, tungsten, zirconium or new nanostructure materials (such as carbon or boron nitride nanotubes), is now possible.

Because the additional processing steps for the removal of solvents and other extraction techniques is not required in the processing of the MICS described in this patent, the process may be used in applications where low cost processing is desired.

An additional advantage to eliminating the solvent extraction step is that uniform and continuous contact between oxidizer and fuel is provided as well as an electrically conductive pathway which provides spark insensitivity to the MIC material and affects their combustion by the input of electrical current. The metal fuels never dissolve but instead remain suspended in liquid, and are universally dispersed within the 3D network rather than agglomerating in certain regions wherein they would lose their beneficial stoichiometric relation.

In an alternative formulation, a HAN/AN (95/5) mixture is used as the energetic ionic liquid oxidizer. In this case, this liquid dissolves and forms a sol-gel structure with the 99+% hydrolyzed polyvinyl alcohol (average molecular weight of 146,000-186,000) at polymer levels up to 16 percent. This sol-gel mixture may be mixed at room temperature with a crosslinking agent such as Boric Acid to form a firm rubbery gel formed after curing the mixture for 1 day at 50° C. Using hot water as the solvent a sol-gel containing only four percent by weight PVA, polymer can be prepared to yield a soft rubbery gel known commercially as "slime". The choice of eutectic salt mixtures is critical. The addition of more than 10% AN to the HAN will prevent complete adsorption of the HAN in the PVA. If the co-polymer of polyvinyl alcohol/polyvinyl amine nitrate is used, HAN/AN ionic liquids up to 20% AN by weight will form stable gels. When the polymer is either polyvinylamine nitrate (PVAN) or polyethylenimine nitrate (PEIN), AN levels as high as 80% by weight of the ionic liquid can be used. As an example, AN eutectic such as Ammonium Nitrate/Guanidine nitrate, ethanol amine nitrate or ethylene diamine nitrate containing over 80% by weight AN will dissolve the polymer and provide castable liquids with heating at polymer levels up to 16% by weight, whereas water will only dissolve up to 2% by weight when heated.

One application for MICs creating using the disclosed method takes advantage of the fact that the MICs formed utilizing micron-sized aluminum have demonstrated that they can be electrically controlled. Current MICs utilizing metal powders once initiated with an electric current continue to burn, whereas MICs formed utilizing aluminum and/or, B, tungsten, molybdenum, copper, zirconium metals, glasses and composites of such with the HAN based oxidizer and polymer can be pulsed to form controlled pulsed burning/energetic reactions. Thus, the MICs disclosed herein (see Tables 2A and 2B and FIG. 5) are a more effective propellant, particularly for uses such as micro thrusters on satellites, projectiles and/or missiles. Indeed, the aluminum based MICs disclosed above may compose thrusters that are both safe from accidental ignition and that have the capacity for an electrically controllable thrust/burn rate. Such environments where this would be desirable include ship based missile systems, bombs, warheads, satellites and the like. The controllable thrust propellant disclosed herein provides chemical thrust for more rapid movement and threat avoidance combined with the capability of producing low thrust.

In another exemplary application, electrical power far in excess of what is needed is supplied to the MIC composition. Here, the electrical power superheats the combusted gasses into a plasma, providing an additional explosive impulse. This may create additional benefits when the propellant is utilized in connection with electric bullet/electrothermal gun applications, or in the oil drilling industry, i.e. more explosive power to fracture rocks and earth can be provided per unit length of pipe. Proppants, essentially inert with regard to the MIC compositions, can be mixed with composition to hold fractures open after treatment, such as in the use of MIC used as down hole explosives or for pumpable gels or liquids used in Oil Enhanced Recovery (OER) rock or sand fracturing.

In another exemplary application, thin films of the MICs described herein may be used in electronics applications. One example is for use as a pyroelectric infrared detector element for sensor systems over a broad temperature range. A pyroelectric sensor is made of a crystalline or structured material that generates a surface electric charge when exposed to heat in the form of infrared radiation. When the amount of radiation striking the material changes, the amount of charge also changes and can then be measured with a sensitive field-effect transistor (FET) device built into the sensor. Crystalline pyroelectric materials such as lead sulfide (PbS), lead selenide (PbSe), indium gallium arsenide (InGaAs), mercury cadmium telluride (HgCdTe), among others, are well known as photodiode, photovoltaic, or photoconductive infrared detector elements.

For our new family of MICs; when applied as thin films to an appropriate field-effect transistor (FET) substrate material provide a means of tailoring infrared detector elements. For this new family of MICs, the uniform distribution by self-assembly of non-reactive metal, glass, ceramic, carbon, polymer and/or other nanophases provides a new means infrared spectral filtering within the detector element. The detector elements may be operated at temperature of between −35° C. and 150° C. in either a cooled or an un-cooled sensor system.

The third type of MIC disclosed herein (Tables 3A and 3B) as described is smokeless and does not generate metal oxides. In addition to the stealth benefits from a smokeless propellant, this formulation does not produce metal oxides that can result in plugging of nozzles. The ability to pulse on and off makes possible multiple ignition events from a single igniter charge. Or potential application for multiple uses need for gas generation to drive a turbine for power generation or for pressurizing for hydraulic or pumping applications.

With respect to the above description then, it is to be realized that material disclosed in the applicant's drawings and description may be modified in certain ways while still producing the same result claimed by the applicant. Such variations are deemed readily apparent and obvious to one skilled in the art, and all equivalent relationships to those illustrated in the drawings and equations and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact disclosure shown and described, and accordingly, all suitable modifications and equivalents may be resorted to, falling within the scope of the invention

We claim:

1. A method of preparing and combusting a metastable intermolecular composite, the method comprising the steps of:

a. preparing a metastable intermolecular composite through the steps of:

i. growing a 3D nanostructure framework in an energetic ionic liquid oxidizer through the addition of a cross-linked polymer;

ii. trapping said liquid oxidizer in said 3D nanostructure; and iii. trapping fuel nanoparticles in said 3D nanostructure;

b. initiating combustion of said metastable intermolecular composite through the application of electric current; and c. wherein said combustion has a rate, wherein said rate may be controlled through alteration of the amount of said electric current applied, and wherein said combustion is terminated through the removal of said electric current.

2. The method according to claim 1 wherein said liquid oxidizer is a eutectic mixture of ammonium nitrate and other organic nitrate salts.

3. The method according to claim 1 wherein said liquid oxidizer and said fuel nanoparticles are substantially uniformly distributed within said 3D nanostructure.

4. The method according to claim 3 wherein said uniform distribution occurs through self-assembly of said liquid oxidizer and said fuel nanoparticles.

5. The method according to claim 1 wherein said initiating and said termination of combustion occurs repeatedly.

6. The method according to claim 5 wherein said combustion occurs as part of a solid, liquid, or hybrid propellant system.

7. The method according to claim 1 wherein said liquid oxidizer comprises hydroxylamine nitrate (HAN).

8. The method according to claim 7 wherein:

a. said metastable intermolecular composite is spark-insensitive; and b. said fuel nanoparticles comprise aluminum.

9. The method according to claim 7 wherein:

a. said fuel nanoparticles comprise PEABN;

b. said composition is spark and flame insensitive; and c. said combustion is smokeless.

10. The method according to claim 1 further comprising trapping and disbursing inert nanoparticles within said 3D nanostructure.

11. The method according to claim 10 wherein said inert nanoparticles are proppants.

12. The method according to claim 11 wherein said liquid oxidizer, and said fuel, said inert nanoparticles are substantially uniformly distributed within said 3D nanostructure.

13. The method according to claim 12 wherein said uniform distribution occurs through self-assembly of said liquid oxidizer, said fuel nanoparticles, and said inert nanoparticles.

* * * * *